US005395252A

United States Patent [19]

White

[11] Patent Number: 5,395,252

[45] Date of Patent: Mar. 7, 1995

[54] AREA AND EDGE ARRAY ELECTRICAL CONNECTORS

[75] Inventor: Robert C. White, Cliffside Park, N.J.

[73] Assignee: Burndy Corporation, Norwalk, Conn.

[21] Appl. No.: 143,433

[22] Filed: Oct. 27, 1993

[51] Int. Cl.[6] ..... H01R 9/09; H01R 25/00

[52] U.S. Cl. ..... 439/66; 439/591

[58] Field of Search ..... 439/66, 65, 591, 80, 439/81, 82, 74, 885

[56] References Cited

U.S. PATENT DOCUMENTS

| | | | |
|---|---|---|---|
| 4,906,194 | 3/1990 | Grabbe | 439/71 |
| 4,927,369 | 5/1990 | Grabbe et al. | 439/66 |
| 4,961,709 | 10/1990 | Noschese | 439/66 |
| 4,969,826 | 11/1990 | Grabbe | 439/66 |
| 4,975,062 | 12/1990 | Evans et al. | 439/65 X |
| 5,069,627 | 12/1991 | Buck et al. | 439/66 |
| 5,092,783 | 3/1992 | Suarez et al. | 439/71 |
| 5,139,427 | 8/1992 | Boyd et al. | 439/591 |
| 5,184,962 | 2/1993 | Noschese | 439/66 |
| 5,259,769 | 11/1993 | Cruise et al. | 439/65 X |

OTHER PUBLICATIONS

"Plated Through-Hole Contact", Schick, H. C., IBM Technical Disclosure Bulletin. vol. 6, No. 10, Mar. 1964, pp. 5-6.

*Primary Examiner*—P. Austin Bradley
*Assistant Examiner*—Jeanne M. Elpel
*Attorney, Agent, or Firm*—Perman & Green

[57] ABSTRACT

An electrical connector having a housing and a plurality of electrical contacts. The housing has contact receiving areas with a general uniform cross-like shape. The electrical contacts are one-piece serpentine shaped spring contacts connected to the housing in the receiving areas. A center section of the contact has mounting wings that are located in lateral apertures of the cross-like shape to fixedly mount the contacts to the housing. Opposite ends of the contacts extend out of the receiving areas for contacting contact pads on parallel printed circuit boards on opposite sides of the connector.

11 Claims, 2 Drawing Sheets

AREA AND EDGE ARRAY ELECTRICAL CONNECTORS

BACKGROUND OF THE INVENTION

1. Field of the Invention

The present invention relates to electrical connectors and, more particularly, to area array and edge array electrical connectors.

2. Prior Art

Numerous different types and kinds of area array electrical connectors and edge array electrical connectors exist in the art. U.S. Pat. No. 4,961,709 (Re. 34,084) discloses one such connector with coiled column shaped contacts. U.S. Pat. No. 4,906,194 discloses a serpentine contact used in an edge array electrical connector. U.S. Pat. Nos. 5,184,962; 4,969,826; 4,927,369; 5,092,783; 5,061,192; and 5,069,627 disclose other types of contacts and connectors. Even in view of the above mentioned contacts and connectors, there exists a need for a connector for connecting parallel electrical components that has very small contacts, which is dependable and relatively easy to manufacture, and can be manufactured at a relatively low expense.

SUMMARY OF THE INVENTION

In accordance with one embodiment of the present invention an electrical connector is provided comprising a housing and a plurality of spring contacts. The housing has a plurality of contact receiving areas. The spring contacts are one piece serpentine shaped contacts connected to the housing in the receiving areas. The contacts have two reversely orientated spring arms connected by a center section. Ends of the spring arms of each contact extend out of opposite open ends of one of the receiving areas and, the center section has mounting wings that connect the contacts to the housing.

In accordance with another embodiment of the present invention an electrical connector is provided comprising a housing and a plurality of electrical contacts. The housing has a plurality of contact receiving areas extending through the housing from a first side to a second side. The receiving areas have a uniform general cross-like shape. The electrical contacts are connected to the housing in the receiving areas. The contacts are comprised of a sheet of flat metal that is cut and stamped into dual spring arms with lateral mounting wings. The dual spring arms extend out of the receiving areas at the first and second sides and, the lateral mounting wings fixedly mount each contact to the housing.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
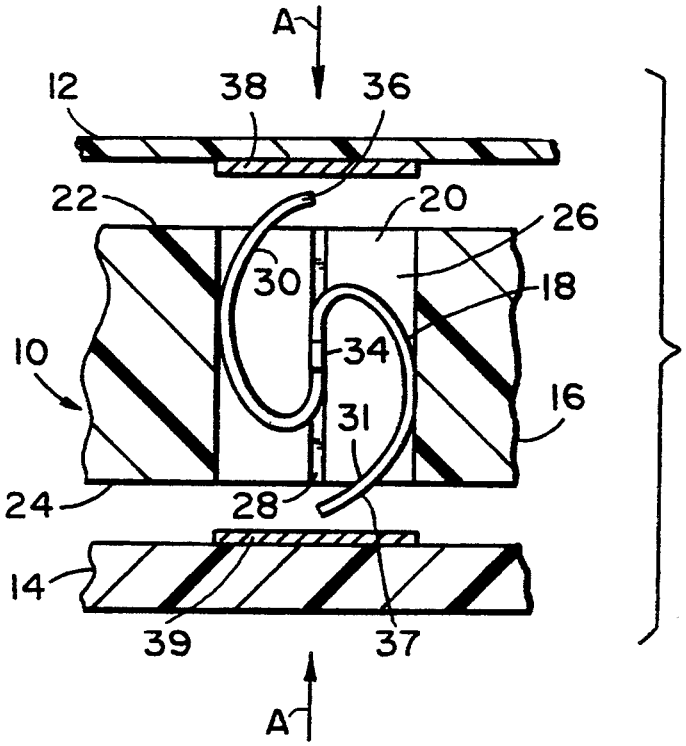
FIG. 1 is a partial schematic cross-sectional view of an electrical connector incorporating features of the present invention for connecting two parallel printed circuit boards to each other.

Referring to FIG. 1, there is shown a partial cross sectional view of an electrical connector 10 incorporating features of the present invention for electrically connecting two parallel printed circuit boards 12, 14 to each other. Although the present invention will be described with reference to the single embodiment shown in the drawings, it should be understood that the present invention can be embodied in various different types and forms of alternate embodiments. In addition, any suitable size, shape and type of elements or materials could be used. Although the present invention will be described with reference to connecting the two parallel printed circuit boards 12, 14 to each other, it should also be understood that the electrical connector 10 can be used to electrical connect other types of electrical or electronic components to each other. Therefore, as used herein, the term printed circuit board should be interpreted to mean any type of electrical or electronic component.

Figure 2:
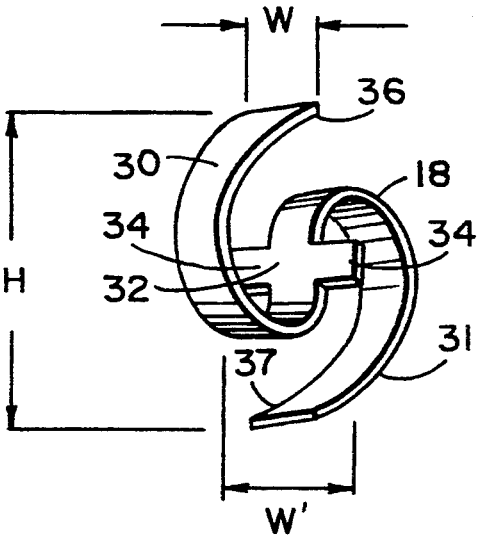
FIG. 2 is a perspective view of the contact shown in the connector of FIG. 1.
Figure 3:
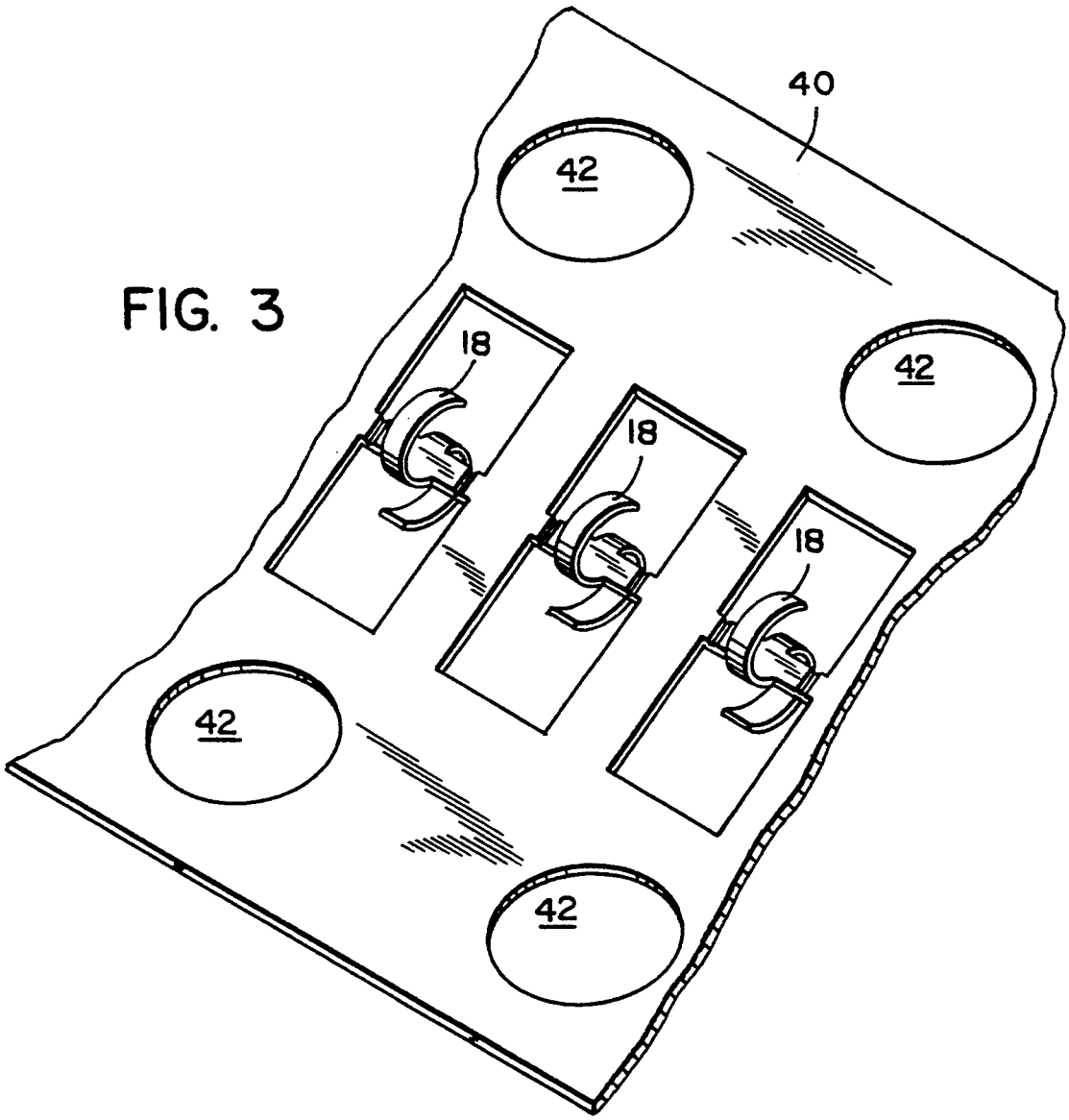
FIG. 3 is a partial perspective view of a sheet of metal that has been cut and stamped to form a plurality of the contacts shown in FIG. 2.
Figure 4:
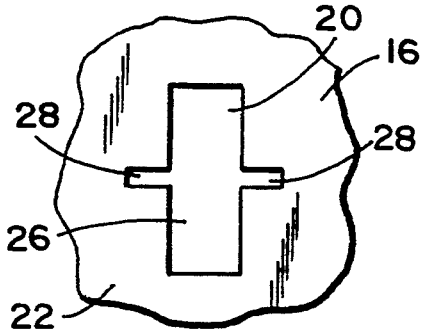
FIG. 4 is a top-plan view of a portion of the housing of the connector shown in FIG. 1 showing a contact receiving area.

Referring also to FIGS. 2–4, the connector 10 generally comprises a housing 16 and a plurality of electrical contacts 18 (only one of which is shown connected to the housing 16 in FIG. 1 for the sake of clarity). The housing 16 is comprised of a dielectric material, such as a molded polymer or plastic material. The housing 16 has a plurality of contact receiving areas 20 (only one of which is shown in FIGS. 1 and 4 for the sake of clarity). The receiving areas 20 extend through the housing 16 from a first side 22 to a second side 24 with a uniform general cross-like shape as seen best in FIG. 4. Each receiving area 20 is comprised of a center aperture 26 and two lateral apertures 28 extending from opposite sides of the center aperture 26 to form the general cross-like shape. In alternate embodiments, the lateral apertures could be angled relative to the center aperture 26 or each other. The important feature in the embodiment shown is that the two apertures 28 extend laterally from the center aperture 26. The contact receiving areas 20 can be arranged in any suitable pattern or array.

The electrical contacts 18 are each mounted to the housing 16 in one of the receiving areas 20. Each contact 18 is a one-piece metal member that has a general serpentine side profile as shown best in FIG. 1. Referring particularly to FIG. 2, each contact 18 has a pair of reversely oriented curved spring arms 30, 31 connected to each other by a center section 32. The arms 30, 31 are substantially the same, but merely reversely oriented. The center section 32 includes two laterally extending mounting wings 34. The height H of the contacts is about 0.05 inch. The width W of the spring arms 30, 31 is about 0.01 inch. The width W' between the opposite ends of the two mounting wings 34, 34 is about 0.026 inch. The thickness of the contact is about 0.003 inch. In alternate embodiments, other sizes or dimensions could be provided.

Each contacts 18 is mounted to the housing 16 with the two mounting wings 34 located in the two lateral apertures 28 and the rest of the contact being located in the center aperture 26 and extending out of the opposite sides 22, 24 as seen in FIG. 1. The ends 36, 37 of the spring arms 30, 31 extend out of the center aperture 26 as shown. The ends 36, 37 are designed to electrically contact pads 38, 39 on the printed circuit boards 12, 14, respectively. When the two boards 12, 14 and connector 10 are sandwiched together as illustrated by arrows A in FIG. 1, the ends 36, 37 are contacted by the contact pads 38, 39 and deflected inward. This forms an electrical spring contact connection between the two pads 38, 39 such that the boards 12, 14 are electrically connected to each other. As noted above, the mounting wings 34 are located in the lateral apertures 28. The mounting wings 34 form an interference fit inside the lateral apertures 28 with the housing 16. This fixedly mounts the center section 32, and thus the entire contact 18, to the housing. In an alternate embodiment, the wings 34 could have barbs or the like at their ends to assist in making the interference fit.

Referring particularly to FIG. 3, there is shown a flat sheet of metal 40 that is used to form the contacts 18. The sheet 40 has indexing holes 42 to allow the sheet 40 to be fed through a cutting and stamping machine (not shown). The machine (not shown) cuts the sheet 40 to form flat contact blanks that are then stamped or otherwise deformed into the series of contacts 18 that can be easily removed from the sheet 40 and connected to the housing 16 of the connector 10. Although similar contact forming techniques are known in the art, the process has been described to emphasize that the contacts 18 are comprised of a flat sheet of metal that has been cut and stamped to form the contacts 18. This is important because contacts made from flat sheet stock material are one of the easiest types of contacts to manufacture and also one of the least expensive types of contacts to manufacture. However, in dealing with small sizes, such as those illustrated by the contact dimensions given above, an increasing problem of securely mounting the contacts to a housing develops. The unique design of the contacts 18, receiving areas 20, and the connection of the contacts to the housing allow original flat sheet stock contacts to be used despite the relatively small size of the contact dimensions with a decreased risk of a failure of the physical mounting of the contacts to the housing. This secure mounting is accomplished by providing the mounting wings 34 with their own apertures 28 that add stability to the wings 34 and prevent the wings from twisting or turning inside the apertures 28 when the arms 30, 31 are deflected. The uniformity of the lateral apertures 28 also assist in connection of the contacts 18 into the receiving area 20 by preventing the mounting wings 34 from bending or turning during insertion of the contacts into the areas 20. The shape of the spring arms 30, 31 also provides adequate deflection and contact force against the pads 38, 39 for a good electrical connection. Thus, the connector 10 has a small size, can be manufactured at a reasonable cost, and has a good physical mounting of the contacts to the housing.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a housing having a plurality of contact receiving areas; and a plurality of one-piece serpentine shaped spring contacts connected to the housing in the receiving areas, the contacts each having two reversely oriented spring arms connected by a center section that combine to form the serpentine shape, ends of the spring arms of each contact extending out of opposite open ends of one of the receiving areas and, the center section having transversely extending mounting wings that extend out of a plane of the serpentine shape and connect the contact to the housing.

2. A connector as in claim 1 wherein the contact receiving areas extend through the housing between a first side and a second side with a uniform general cross-like shape.

3. A connector as in claim 2 wherein the contact receiving areas each have a center aperture and two lateral apertures extending from opposite sides of the center aperture to form the general cross-like shape.

4. A connector as in claim 3 wherein the mounting wings are located in the lateral apertures and the rest of the contacts are located in the center apertures and extending out of the center apertures at the first and second sides.

5. A connector as in claim 1 wherein the contacts are comprised of cut and stamped flat sheet metal.

6. An electrical connector comprising:

a housing having a plurality of contact receiving areas extending through the housing from a first side to a second side, the receiving areas having a uniform general cross-like shape from the first side to the second side; and a plurality of electrical contacts connected to the housing in the receiving areas, the contacts being comprised of cut and stamped flat sheet metal, each contact having a pair of spring arms with lateral mounting wings, the pair of spring arms extending out of the receiving areas at the first and second sides and the lateral mounting wings fixedly mounting each contact to the housing.

7. A connector as in claim 6 wherein the receiving areas each have a center apertures and two lateral apertures extending from opposite sides of the center aperture to form the general cross-like shape.

8. A connector as in claim 7 wherein the lateral mounting wings are located in the lateral apertures.

9. A connector as in claim 6 wherein the contacts have a general serpentine shape.

10. A connector as in claim 6 wherein the contact is about 0.05 inch between opposite ends of the spring arms and the spring arms are about 0.01 inch wide.

11. A connector as in claim 10 wherein the contacts are about 0.003 inch thick and the mounting wings are about 0.026 inch wide.

* * * * *